US008146197B2

(12) United States Patent
Yamada

(10) Patent No.: US 8,146,197 B2
(45) Date of Patent: Apr. 3, 2012

(54) CLEANING DEVICE AND PROCESS FOR PRODUCING THE SAME

(76) Inventor: Kikuo Yamada, Tokyo (JP)

( * ) Notice: Subject to any disclaimer, the term of this patent is extended or adjusted under 35 U.S.C. 154(b) by 1577 days.

(21) Appl. No.: 10/589,760

(22) PCT Filed: Jul. 12, 2005

(86) PCT No.: PCT/JP2005/012867

§ 371 (c)(1),
(2), (4) Date: Aug. 17, 2006

(87) PCT Pub. No.: WO2006/070502

PCT Pub. Date: Jul. 6, 2006

(65) Prior Publication Data

US 2008/0148508 A1 Jun. 26, 2008

(30) Foreign Application Priority Data

Dec. 27, 2004 (JP) ..... 2004-375448
Jun. 2, 2005 (JP) ..... 2005-163349

(51) Int. Cl.
*A47L 13/12* (2006.01)
*A47L 13/20* (2006.01)
*A47L 13/38* (2006.01)

(52) U.S. Cl. ..... 15/229.3; 15/209.1; 15/226; 15/229.4

(58) Field of Classification Search ..... 15/115, 15/209.1, 226, 227, 228, 229.1, 229.2, 229.3, 15/229.7, 229.4
See application file for complete search history.

(56) References Cited

U.S. PATENT DOCUMENTS

| | | | | |
|---|---|---|---|---|
| 6,143,393 | A | 11/2000 | Abe et al. | |
| 6,241,835 | B1 | 6/2001 | Abe et al. | |
| 6,329,308 | B1 | 12/2001 | Kenmochi | |
| 6,813,801 | B2 | 11/2004 | Tanaka | |
| 6,968,591 | B2 | 11/2005 | Tanaka | |
| 2002/0148061 | A1 * | 10/2002 | Tanaka et al. | 15/229.3 |
| 2004/0016074 | A1 | 1/2004 | Tanaka | |

FOREIGN PATENT DOCUMENTS

| | | | |
|---|---|---|---|
| CN | 08-154881 | A | 6/1996 |
| CN | 1221599 | A | 12/1998 |
| EP | 0 923 902 | A2 | 6/1999 |

(Continued)

*Primary Examiner* — Randall Chin
(74) *Attorney, Agent, or Firm* — H. Jay Spiegel; Robert L. Haines

(57) ABSTRACT

A cleaning device superior in dust collecting capacity allows material selection from a wide range of fibers and a base material sheet forming the same and can be produced in a short processing time while preventing thermal deterioration and hardening of the material. A process for producing it is also disclosed. A cleaning device 1 is obtained by providing a large number of filaments 30 aligned in fiber direction with a linear bundling portion 40 connecting the fibers to each other by heat-sealing, forming a filament bundling body 31 previously bundled by the bundling portion 40, and bonding the filament bundling body 31 to a base material sheet 6 by an adhesive. A bristle-like-member-less portion 14 of a brush sheet 9 with a plurality of bristle-like members 8 is integrally bonded to a fiber bundle 7 and the base material sheet 6 by an adhesive.

16 Claims, 9 Drawing Sheets

FOREIGN PATENT DOCUMENTS

| | | |
|---|---|---|
| JP | 3208306 | 5/1997 |
| JP | 10-328107 | 12/1998 |
| JP | 11-276402 A | 10/1999 |
| JP | 2002-065541 | 3/2002 |
| JP | 2002-369783 | 12/2002 |
| JP | 2003-039585 | 2/2003 |
| JP | 2003-265389 | 9/2003 |
| JP | 2004-298650 | 10/2004 |

* cited by examiner

CLEANING DEVICE AND PROCESS FOR PRODUCING THE SAME

TECHNICAL FIELD

The present invention relates to a cleaning device for wiping off dirt such as dust and a process for producing the same and, more specifically, to a cleaning device having a sheet-like base material to which fibers are bonded and a process for producing the same.

BACKGROUND ART

To remove dust adhering to a piece of furniture such as a chest of drawers, an electric appliance such as a personal computer or a light, a wall in a building, a threshold, a lintel, etc., various cleaning devices have conventionally been used. A typical example of such cleaning devices is a duster. Generally speaking, however, a duster, which removes dust by scattering it away from the object of cleaning, has no function by which it wipes off dust. In order to solve this problem, there has been proposed a cleaning device composed of a sheet of non-woven fabric or the like and a fiber bundle, and is currently in use.

For example, Japanese Patent Application Publication No. 2004-298650 discloses an invention related to a cleaning mop formed by fusing (heat-sealing) fibers or strip-shaped films with fusibility to a base material. Further, Japanese Patent No. 3208306 discloses an invention related to a disposable wipe-off device formed by integrating a fusible sheet and fusible fibers.

In the cleaning devices according to these inventions, a fusible material is selected and used for both the fibers and the base material sheet. As a process for producing these cleaning devices, there is adopted a heat-sealing system in which the fibers and base material sheet are integrally bonded together through melting by heat.

DISCLOSURE OF THE INVENTION

While there is an advantage that it is possible to conduct an operation in a small number of steps in the above-described conventional technique for bonding integrally the fibers and the base material sheet by heat sealing, the following problems occur.

First, even though only a small number of steps is required in the above stated system, the system requires still a long time for sufficient heating of the fibers and the base material sheet to be completely heat-sealed, resulting in the long operating time and high cost therefor.

Second, when the fibers and the sheet are formed of different materials, it is rather difficult to integrate them uniformly and reliably by heat sealing. That is, the melting temperatures of the fibers and the sheet are not always the same, therefore, in order to bond them together to a sufficient degree by the heat sealing, it is necessary to perform heating at a sufficiently high temperature also on the material with a higher melting temperature. Thus, the material with a lower melting temperature is placed in an overheated state, resulting in thermal deterioration or a reduction in durability of the material.

Third, it is necessary to select a fusible material for both the fibers and the base material sheet. Thus, if, for example, the material of the base material sheet is to be changed to some other material superior in strength and durability, such changing may be limited due to the low degree of freedom in material selection.

Fourth, when performing bonding by heat sealing, for uniform heating, the materials are generally heated and pressurized by a press heater with a small abutment width with respect to the materials to be heat-sealed, with the result that the bonding portion exhibits a linear configuration. On the other hand, when this abutment width is enlarged to effect heat sealing with a large bonding area, the amount of heat to be imparted to the press heater is enormous, resulting in high processing cost; further, heat spots are likely to be generated in the materials heated. As a result, a sufficient amount of heat is not imparted to a part of the materials, so that the heat sealing in that part is rather unsatisfactory, or an excessive amount of heat is imparted to another part, resulting in thermal deterioration.

Fifth, when performing heating and pressurization on the fibers and the base material by a press heater for heat sealing, highly concentrated load is generally applied to the linear bonding portion. Thus, when, in particular, the base material is a thin sheet member, a convex press mark is likely to be generated on the sheet upper surface on the side opposite to the surface (lower surface) to which the fiber are bonded. When such a press mark is generated, not only the outward appearance of the product but also the smoothness of the sheet upper surface is impaired. Thus, when the conventional heat sealing system is adopted, there are involved problems, such as a deterioration in the workability of the sheet upper surface, and a deterioration in the dust collecting capacity when the sheet upper surface is used as the cleaning sheet. Further, in the case of such heat sealing system, there is a fear of the surface to be cleaned being damaged during cleaning by the thermally hardened heat-sealed portion.

In view of these problems, it is an object of the present invention to provide a cleaning device which is superior in dust collecting capacity and which allows material selection from a wide range in terms of the fibers and the base material sheet forming the same and can be produced in a short processing time while preventing thermal deterioration in and thermal hardening of the material, and a process for producing the same.

The cleaning device of the present invention is characterized by comprising a fiber bundle composed of a large number of fibers bonded to a base material sheet by means of an adhesive. Thus, even when either the fibers or the base material sheet or both materials are devoid of fusibility, it is possible to obtain the cleaning device of the present invention, so that material selection is possible from a wider range than in the prior art. Thus, according to the requisite specifications, such as the configuration and durability of the base material, and recycling property, it is possible to freely make material selection even from materials with no fusibility.

Further, a bonding system using an adhesive is adopted, so that even when the fibers and the base sheet are formed of different materials, it is possible to effect integral bonding of these members reliably and uniformly. Further, since it is possible to select the hardness of the adhesive, if a soft adhesive is adopted, there is no fear of thermal hardening of the bonding portion or damaging of the surface to be cleaned as in the case of the heat sealing system. Further, by using a hot melt type adhesive, it is possible to effect bonding by solely heating and cooling the materials to a relatively low temperature, thereby substantially reducing the processing time and the processing cost.

In the case of the conventional heat sealing system, the bonding portion, which is generally of a narrow and linear configuration, undergoes concentrated heating and pressurization in order to melt the materials to be heat-sealed to a sufficient degree and to effect heat sealing without involving any spots. Thus, in the case of the conventional heat sealing system, in particular, in which the base material is a thin-walled sheet and in which a large number of filaments are placed on the base material for integral heat pressing, a convex press mark is generated on the upper surface side of the base material sheet, resulting in various problems. In contrast, in the system of the present invention, in which the base material sheet and a fiber bundle of filaments are bonded together by means of an adhesive, it is possible to avoid local application of load, so that the upper surface material of the base material sheet advantageously suffers little damage regardless of the thickness thereof.

In the cleaning device of the present invention, the bristle-like-member-less portion of the brush sheet with a plurality of bristle-like members may be integrally bonded to the fiber bundle and the base material sheet by means of an adhesive. In this case, through a combination of the brush sheet and the fiber bundle, it is possible to efficiently scrape out and collect dust. Further, of the brush sheet, the bristle-like-member-less portion thereof is bonded to the base material sheet or the fiber bundle, so that integration therewith can be reliably effected with a small amount of adhesive.

Further, the fiber bundle may be a filament bundling body provided with a bundling portion connecting filaments aligned in the fiber direction with each other. Due to this arrangement, even when the cleaning device is repeatedly used, there is no fear of damage due to a fray of fibers, making it possible to obtain a cleaning device superior in wear resistance. Further, if, as far as the filaments are concerned, they are connected with each other by heat sealing, the bonding between the filament bundling body and the base material sheet is effected by an adhesive, whereby it is possible to achieve an enhancement in production efficiency for the cleaning device as a whole.

In the present invention, the base material sheet may have a plurality of strips, whereby it is possible to enhance the dust collecting capacity of the cleaning device.

The fiber bundle composed of a large number of fibers may be formed by stacking together a fiber bundle formed of fibers of a small degree of fineness and a fiber bundle formed of fibers of a large degree of fineness. Further, the fibers forming the fiber bundle and the brush sheet may be formed of materials different from each other. By using different materials for the components, the cleaning device is composed of a combination of components differing in dust collecting capacity, so that it is possible to further enhance the dust collecting capacity of the cleaning device as a whole.

The fiber bundle may be provided between the base material sheet and the brush sheet.

The bristle-like members of the brush sheet may have a width larger than the diameter of the fibers forming the fiber bundle.

The bundling portion connecting filaments to each other may be provided linearly in a direction crossing the filaments.

The bonding portion between the filament bundling body connecting the filaments to each other and the base material sheet may be provided linearly or in the form of a plurality of spots.

The filament bundling body may be bonded to the base material sheet at the bonding portion of a predetermined width located at a substantially central position with respect to the fiber direction.

The adhesive used is preferably a hot melt type adhesive and may contain a coloring agent.

The base material sheet may have a handle mounting portion.

The fiber bundle may be provided on both the upper and lower sides of the base material sheet.

A process for producing a cleaning device according to the present invention includes: aligning a large number of filaments with fusibility in fiber direction; fusing together the substantially central portions of the filaments by fusing means to form a filament bundling body; applying an adhesive to the position corresponding to a bonding portion between the filament bundling body and a base material sheet; stacking together the filament bundling body and the base material sheet; and bonding together the filament bundling body and the base material sheet at the position of the bonding portion.

Further, according to the present invention, a cleaning device can be manufactured by a method including: aligning a large number of filaments with fusibility in fiber direction; fusing together the substantially central portions of the filaments by fusing means to form a filament bundling body; applying a hot melt type adhesive to the position corresponding to a bonding portion between the filament bundling body and a base material sheet; stacking together the filament bundling body and the base material sheet; heating the filament bundling body and the base material sheet to a temperature not lower than the melting temperature of the hot melt type adhesive by a press heater and pressurizing the filament bundling body and the base material; and heating the position of the bonding portion to a temperature not lower than the fusion temperature of the filaments by a hot cutter and pressurizing the position of the bonding portion to bond together the filament bundling body and the base material sheet at the position of the bonding portion.

BEST MODE FOR CARRYING OUT THE INVENTION

Figure 1:
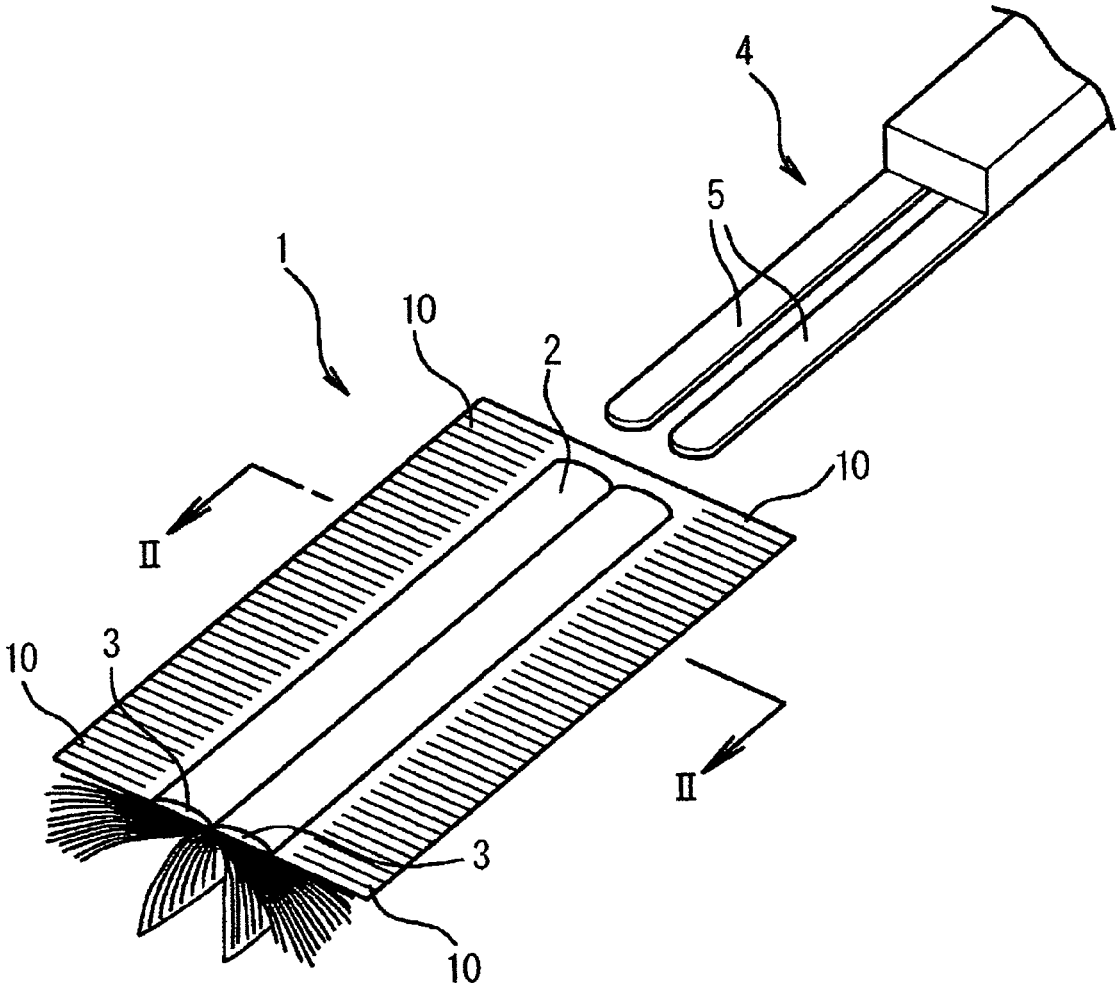
FIG. 1 is a perspective view of a cleaning device according to a first, embodiment of the present invention.

In the following, embodiments of the present invention will be described specifically with reference to the drawings. The present invention, however, is not restricted to the following embodiments, for example, in terms of the outer configuration of the fiber bundle and the base material sheet, the application configuration and application position of the adhesive, the position where the fibers are bundled with each other, and the presence and the configuration of the handle. FIG. 1 is a perspective view of a cleaning device according to a first embodiment of the present invention.

Figure 2:
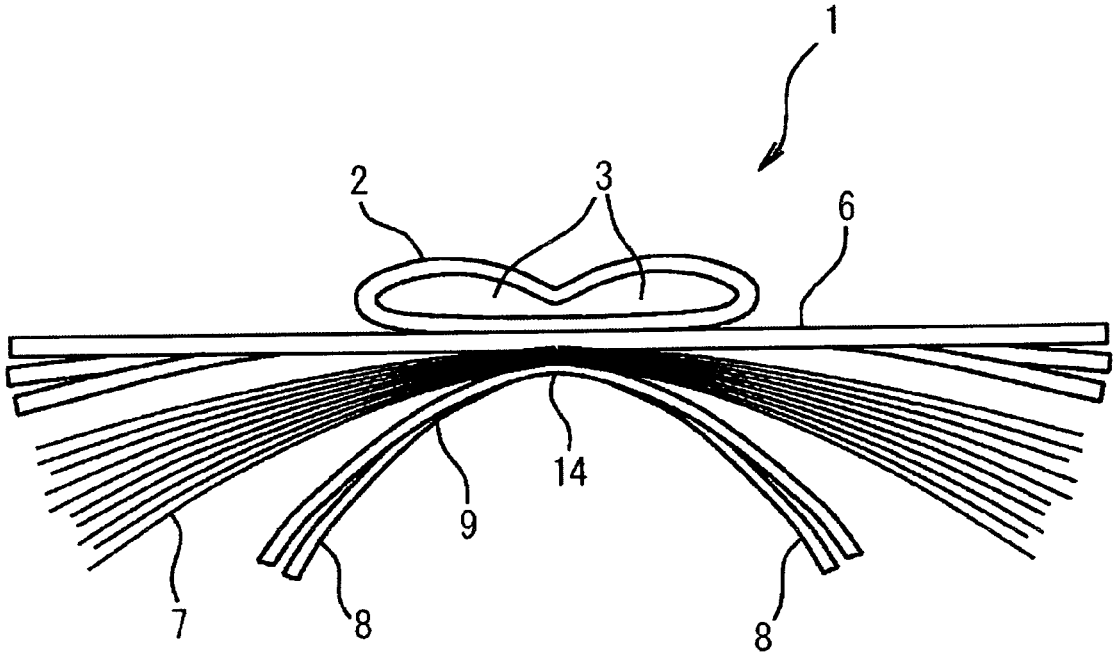
FIG. 2 is a longitudinal sectional view taken along line II-II of FIG. 1.

In the drawing, reference numeral 1 indicates a cleaning device. The cleaning device 1 has a handle mounting portion 2. Support bars 5 of a handle 4 are inserted into insertion holes 3 of the handle mounting portion 2, whereby the cleaning device can be used as a hand mop. The cleaning device 1 of the present invention is formed by integrally bonding a base material sheet 6 to a fiber bundle 7 consisting of a large number of fibers bundled together in a sheet-like form. Further, as shown in FIG. 2, in the cleaning device 1 of this embodiment, a brush sheet 9 with bristle-like members 8 is bonded to the fiber bundle 7 and integrated therewith. Regarding the order in which the fiber bundle 7 and the brush sheet 9 are stacked, it does not matter which of them comes on the upper side and is bonded to the base material sheet 6. In this embodiment shown, the fiber bundle 7 is bonded between the base material sheet 6 and the brush sheet 9 and integrated therewith. In the present invention, the fiber bundle 7 formed of fibers and the bristle-like member 8 of the brush sheet 9 will be generally referred to as a main cleaning portion for performing dust collection.

The base material sheet 6 is a thin-walled base of the cleaning device. The base material sheet 6 supports the main cleaning portion and is itself capable of being flexibly deformed according to the configuration of the surface to be cleaned; it is a member having a function by which a satisfactory dust collection performance can be obtained for the cleaning device. While there are no particular limitations regarding its thickness and configuration, it is generally a sheet having a thickness of 1 mm or less and a circular, oblong, elliptical, or rectangular outer configuration. Regarding the material of the base material sheet 6, there are no particular limitations as long as it allows the main cleaning portion to be suitably bonded thereto by an adhesive. For example, a sheet of paper, synthetic resin sheet, or non-woven fabric sheet is used as the base material sheet 6. Of these, from the viewpoint of lightness, strength, durability, and adhesion property, non-woven fabric is suitably used. While it is possible to use as the non-woven fabric spunlace non-woven fabric, spunbond non-woven fabric, thermal bond non-woven fabric, air-through non-woven fabric, point bond non-woven fabric, etc., spunbond non-woven fabric and thermal bond non-woven fabric are preferable. Any of natural fibers, synthetic fibers, and composite fibers may be used as the fibers to form the non-woven fabric. The basis weight of the non-woven fabric preferably ranges from approximately 20 $g/m^2$ to 100 $g/m^2$. Of the base material sheet 6, a lower surface thereof bonded to the main cleaning portion may be subjected to surface treatment, such as degreasing, filling-up, or surface roughening.

As shown in FIG. 1, the base material sheet 6 may have, in its peripheral edge portion, a plurality of strips 10 to form a sub-cleaning portion. In this embodiment, the plurality of strips 10 are provided on either side of the handle mounting portion 2. The base material sheet 6 does not necessarily consist of a single sheet; it is also possible to form it by stacking together two or more sheets. When forming the base material sheet 6 by stacking together a plurality of sheets, the sheets stacked together are not necessarily of the same kind; it is also possible to stack together sheets of different materials, colors, etc.

The fiber bundle 7 is formed as a sheet consisting of a large number of fibers bundled together, and a plurality of fibers may be collected together to a degree that the fibers do not become loose. However, the fiber bundle 7 may also be one in which the fibers are partially connected together by heat sealing, adhesion, etc. as needed. The fiber bundle 7 can be obtained, for example, by a method in which a large number of sheet-like bundles of filaments are successively bonded together at appropriate intervals in a direction perpendicular to the longitudinal direction of the fibers, and then the intermediate portions between the bonded portions are cut.

In the present invention, a filament refers to a single yarn continuous from the proximal to the distal end. The cleaning device of the present invention is characterized by the use of filaments in the main cleaning portion. This is in order to avoid the following problem: if the main cleaning portion were formed of staples, i.e., short fibers, there would be a fear of the staples, i.e., short fibers twisted together being worn and detached from the main cleaning portion as a result of the repeated use of the cleaning device. Thus, in the present invention, the term filament also covers a yarn formed by twisting together a plurality of filaments into a thick yarn; further, as long as it consists of a single continuous material, there are no particular limitations regarding the sectional dimension, configuration, etc. of the filament.

As the fibers forming the fiber bundle 7, it is possible to use, for example, natural fibers, such as cotton or wool, synthetic fibers, such as polyethylene, polypropylene, polyethylene terephthalate, nylon, or polyacrylic fiber, a composite fiber, such as a sheath-core fiber, an island fiber, or a side-by-side fiber, or the like. Of these, when connecting the fibers with each other by heat sealing, it is desirable to use a sheath-core type composite fiber whose core consists of polypropylene and whose sheath consists of polyethylene. For, such a composite fiber exhibits both the superior fusibility of polyethylene forming the sheath and the firmness of polypropylene forming the core. Further, it is also possible to adopt a crimped fiber obtained by machine crimping, heat crimping, etc. As the fiber bundle 7, it is possible to use a filament bundle generally called tow, which is produced from polyethylene, polypropylene, nylon, polyester, rayon, etc.

As the fibers forming the fiber bundle 7, there are used ones having a thickness of approximately 0.01 mm to 0.3 mm. The fiber bundle 7 may be formed of fibers of the same material, the same degree of fineness, the same color, etc., or it may be formed of two or more kinds of fibers differing in them. Further, it is also possible to stack together two or more fiber bundles 7 of a planar configuration. In this case, it is possible to arbitrarily combine sheet-like fiber bundles differing in thickness, fiber color, and the kind of constituent fiber. By stacking together fiber bundles of different colors, it is possible to achieve an improvement in terms of the artistic design of the cleaning device. When stacking together two or more fiber bundles 7, it is particularly desirable to alternately stack together fiber bundles formed of thin fibers and fiber bundles formed of thick fibers, for, in such a construction, the thick, firm fibers function to scrape out dust, and the thin fibers function to take in the dust scraped out, thus making it possible to perform cleaning effectively; this construction is also preferable in that the thick fibers contribute to preventing entanglement of the thin fibers with each other. The diameter of the thin fibers preferably ranges from 0.01 mm to 0.05 mm. The diameter of the thick fibers, which is acceptable as long as it is larger than that of the thin fibers, preferably ranges from 0.06 mm to 0.3 mm. When stacking together a plurality of sheet-like fiber bundles differing in fiber thickness, fiber kind, color, etc., there are no particular limitations regarding the number of fiber bundles to be stacked together; usually, the number preferably ranges from 2 to 10.

There are no particular specific limitations regarding the fiber length; it generally ranges from approximately several centimeters to several tens of centimeters. The individual fibers may be of a uniform length or exhibit a variation.

Figure 3A:
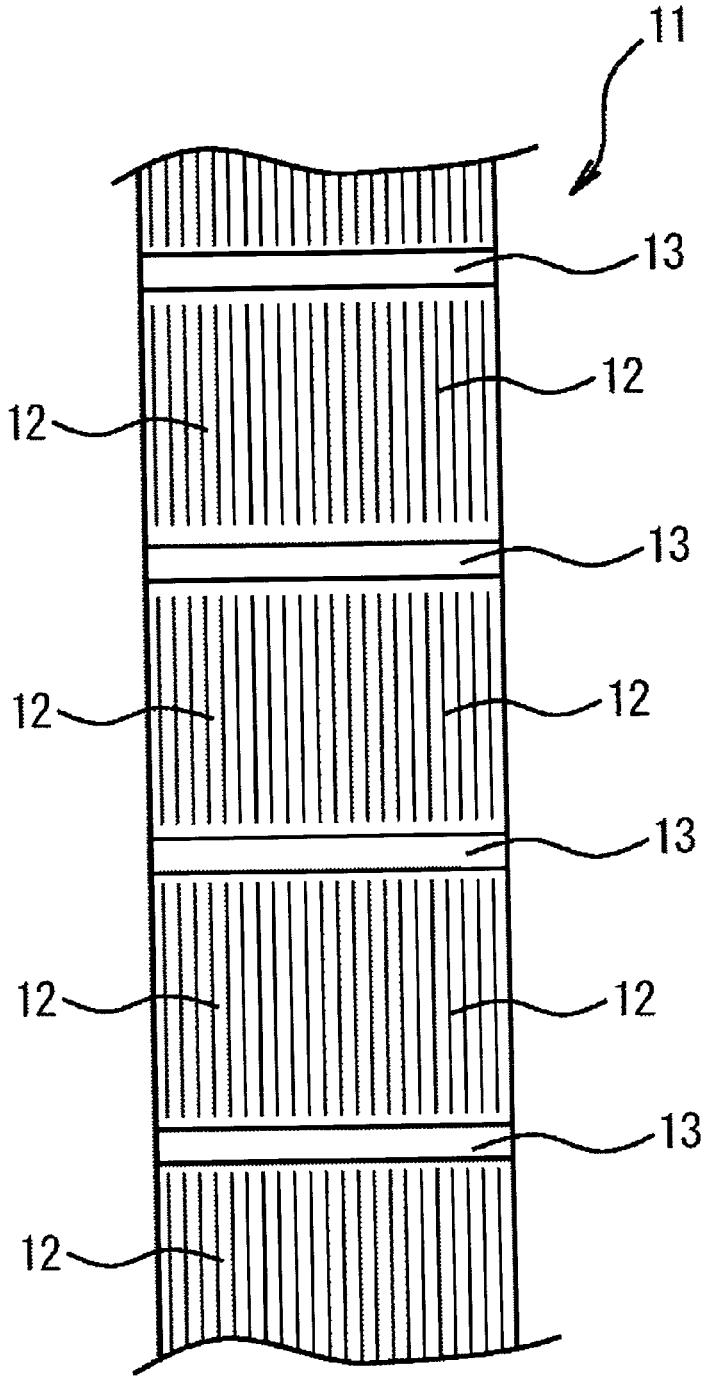
FIG. 3A is a plan view showing how a brush sheet of a cleaning device according to the present invention is produced.
Figure 3B:
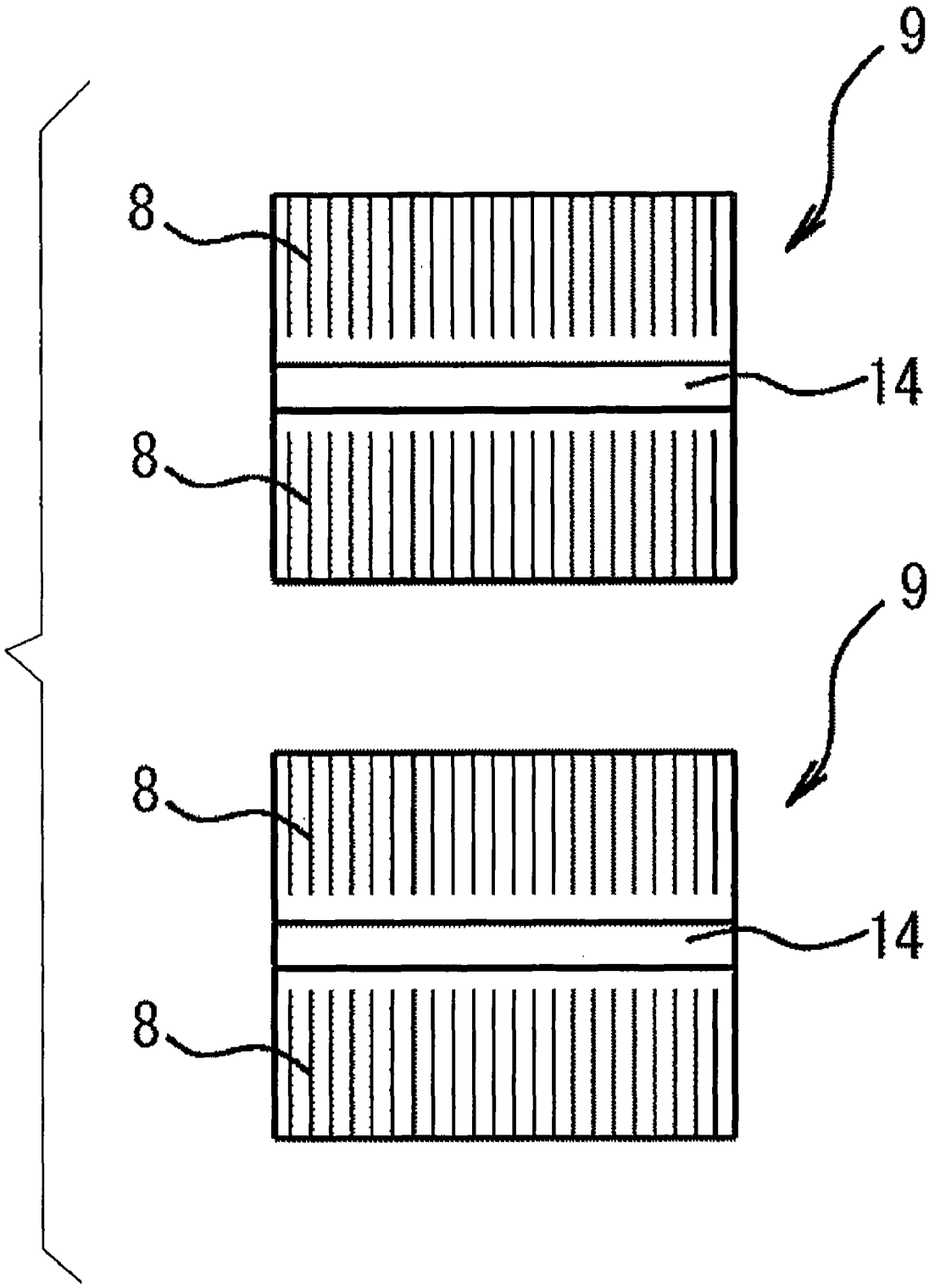
FIG. 3B is a plan view of each brush sheet produced by cutting a continuous form of the brush sheets as shown in FIG. 3A for the cleaning device according to the present invention.

The brush sheet 9, which can be formed, like the base material sheet 6, of paper, non-woven fabric, synthetic resin sheet, etc., is preferably formed of a synthetic resin sheet. FIGS. 3A and 3B are plan views illustrating a method of producing the brush sheet 9. First, cutting is performed on an elongated sheet 11 along the longitudinal direction thereof to form a large number of cuts 12 such that cut-less portions 13 are intermittently provided as shown in FIG. 3A. Then, the substantially central portions of the cuts 12 are cut in the width direction of the sheet 11, thereby obtaining a plurality of brush sheets 9 in each of which there are a large number of bristle-like members 8 on either side of bristle-like-member-less portions 14 as shown in FIG. 3B. It is desirable for the bristle-like members 8 to have a width larger than the diameter of the fibers forming the fiber bundle 7. As the materials of the synthetic resin sheet for forming the brush sheet 9, polyethylene, polypropylene or the like are listed as examples. It is also possible to stack together a plurality of brush sheets 9.

Figure 4:
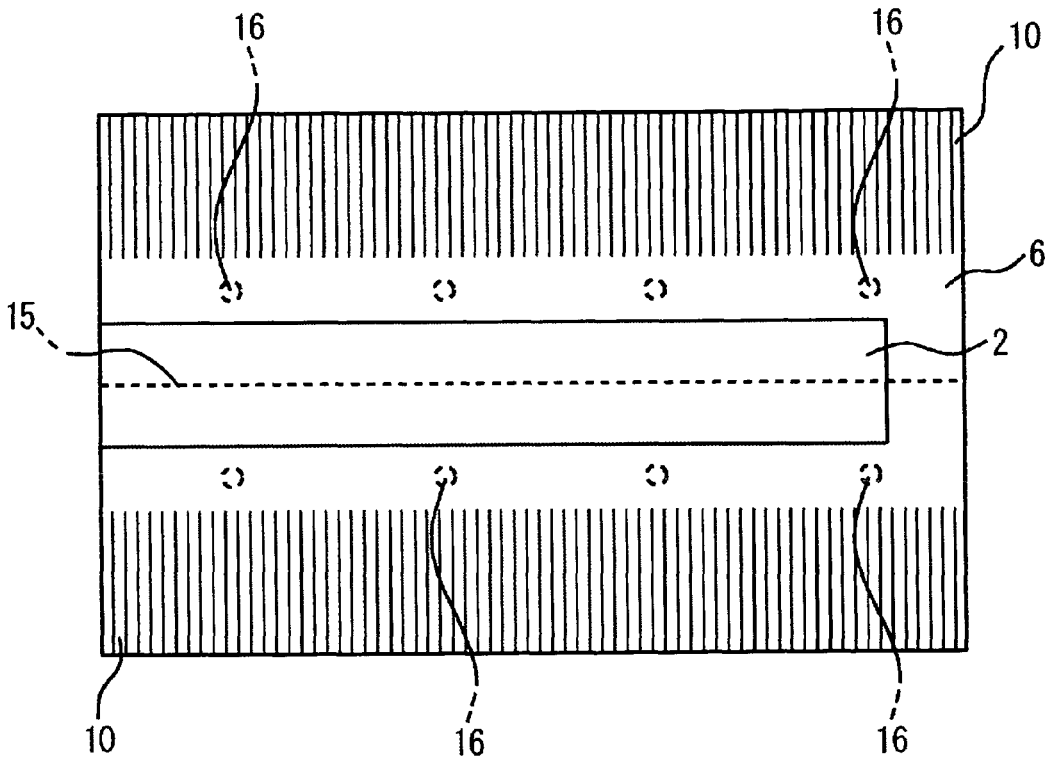
FIG. 4 is a plan view of a cleaning device according to the present invention.

In the cleaning device 1 of the present invention, the base material sheet 6 and the fiber bundle 7 are glued to each other at least in part, and are integrally bonded together. Further, at least apart of the bristle-like-member-less portion 14 of the brush sheet 9 is integrally bonded to the base material sheet 6 and the fiber bundle 7 by means of an adhesive. As the method of partially gluing the base material sheet 6, the fiber bundle 7, and the brush sheet 9 to each other, there is adopted, for example, a method in which, as shown in FIG. 4, adhesion is effected by an adhesive 15 linearly applied and an adhesive 16 applied in a spot-like fashion.

Examples of the adhesive that can be used include emulsion type adhesive, two component setting type adhesive, thermoplastic resin type adhesive, elastomer type adhesive, thermosetting resin type adhesive, instant adhesion type adhesive, and hot melt type adhesive. Of these, a hot melt type adhesive is preferable in that it allows quick adhesion operation by heating and cooling thereof. Alternatively, a solution type or emulsion type thermoplastic adhesive and an elastomer type adhesive are preferable in that they exhibit good permeability with respect to the fibers and provide a deep adhesive layer.

Of the base material sheet 6 and the fiber bundle 7, the adhesive may be previously applied to either or both of them. As the adhesive 15, 16, it is possible to use an adhesive containing a coloring agent. When an adhesive containing a coloring agent is used, the color of the adhesive can be seen through from above the base material sheet, making it possible to impart an artistic design property to the cleaning device 1 through contrast with the color of the base material sheet 6. Further, when the colored adhesive 15 is applied linearly so that the color of the adhesive can be seen around the center of the handle mounting portion 2, the positioning of the central position when inserting the support bars 5 of the handle 4 is facilitated.

In the cleaning device 1 of the present invention, the colors of the base material sheet 6, the fiber bundle 7, and the brush sheet 9 can be made different. By using components of different colors in a combination, an improvement is achieved in terms of artistic design. The cleaning device 1 of the present invention is also used as a disposable type cleaning device, and, after use, the cleaning portion 1 can be pulled out of the handle portion 2 to be replaced by a new cleaning portion 1.

Figure 5:
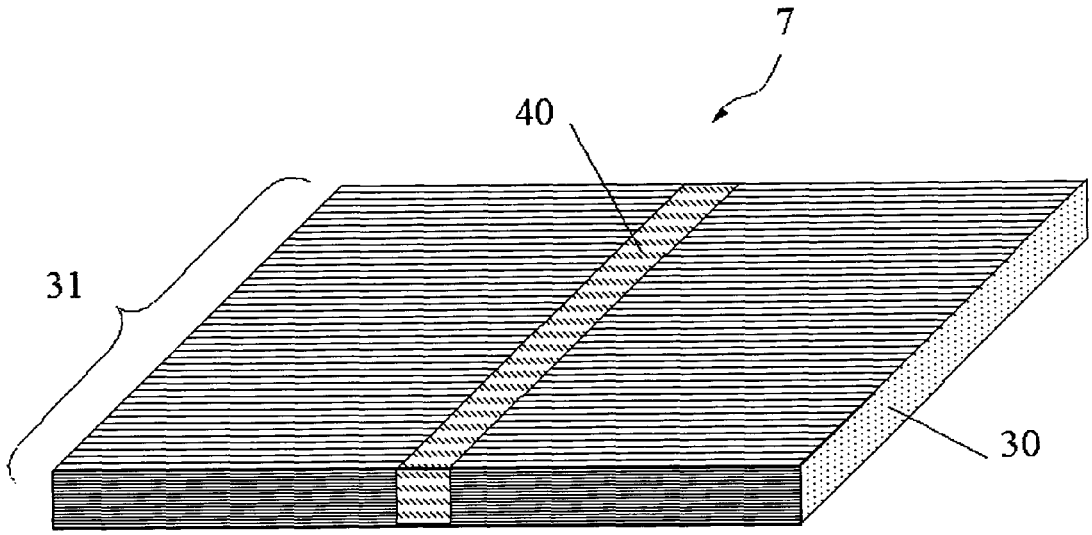
FIG. 5 is a perspective view of a filament bundling body of a cleaning device according to a second embodiment of the present invention.

FIG. 5 is a perspective view of a fiber bundle 7 according to a second embodiment of the present invention. In this embodiment, the fiber bundle 7 for wiping off dust is formed by a filament bundling body 31 in which a large number of filaments 30 aligned in the fiber direction are connected together by a bundling portion 40.

The fiber direction refers to the longitudinal direction of the filaments 30. In the filament bundling body 31, the fibers are bundled in a state in which their directions are aligned. It should be noted, however, that the filament bundling body 31 does not exclude a construction in which a slight amount of other fibers are mingled so as to extend in a direction crossing the large number of filaments 30 forming the filament bundling body. Further, to achieve the object of the present invention, apart from extending in a straight line to form the filament bundling body 31, the filaments 30 may also be bent entirely or locally. Thus, in the present invention, when it is said that the filaments 30 are aligned in the fiber direction, this is intended to preclude a state in which the fibers are oriented at random; that is, this is intended to mean that the general configurations and orientations of the filaments 30 are analogous to each other, without having to strictly coincide with each other in the fiber direction.

The large number of filaments 30 aligned in the fiber direction are first bundled with each other at the bundling portion to form the filament bundling body 31. There are no particular limitations regarding the configuration of the filament bundling body 31; it may be, for example, of a planar, a straw-bag-like, or a block-like configuration. In bundling, the large number of filaments 30 are collected in a predetermined fiber density in the radial direction. In contrast, in the fiber direction, they may be collected while aligned at their one end or center, or collected in an irregular state.

There are no particular limitations regarding the means for bundling together the filaments 30 to obtain the filament bundling body 31, and it is possible to select a suitable means according to the material of the filaments 30. When the filaments 30 consist of a material with fusibility, heat sealing is suitable from the viewpoint of the number of processes and the processing time. As the heating method, a heating/pressurizing system using a press heater, or an ultrasonic fusion system may be used. Apart from this, impregnation with adhesive or mutual binding of the filaments 30 by sewing is possible. Further, it is also possible to combine these methods with each other.

The material of the filaments 30 may be selected from the filament materials mentioned with reference to the first embodiment. Further, as the filaments 30, it is possible to use ones of the same material and the same degree of fineness (thickness), or a plurality of kinds mixed together. In particular, by combining fibers of different degrees of fineness with each other, it is possible to achieve an improvement in terms of dust scraping-out performance, and to advantageously prevent entanglement of the fibers. When obtaining the filament bundling body 31 by bundling together filaments 30 of different kinds of material with heat sealing, common materials are adopted, or materials whose melting points are close to each other are selected. These purposes are to prevent thermal deterioration of the material due to excessive heating during heat sealing and to achieve an improvement in operational efficiency.

There are no particular limitations for the bundling portion 40 constituting the bundling portion of the filaments 30 regarding the place, configuration, and number thereof. For example, when connecting together the filaments 30 impregnated with adhesive, the bundling portion 40 has a predetermined width. In the case of connection by heat sealing, the linear bundling portion 40 is generally provided in a direction crossing the filaments. However, there is no need for all the filaments 30 constituting the filament bundling body 31 to be integrally connected by one bundling portion 40; it is also possible for the whole to be connected by two or more bundling portions 40. That is, as long as all the filaments 30 are connected with any of the other filaments 30 and not separated from the filament bundling body 31, the bundling portion 40 may be, for example, of a construction in which a plurality of short linear bundling portions crossing the filaments 30 are provided in a zigzag fashion.

Figure 6:
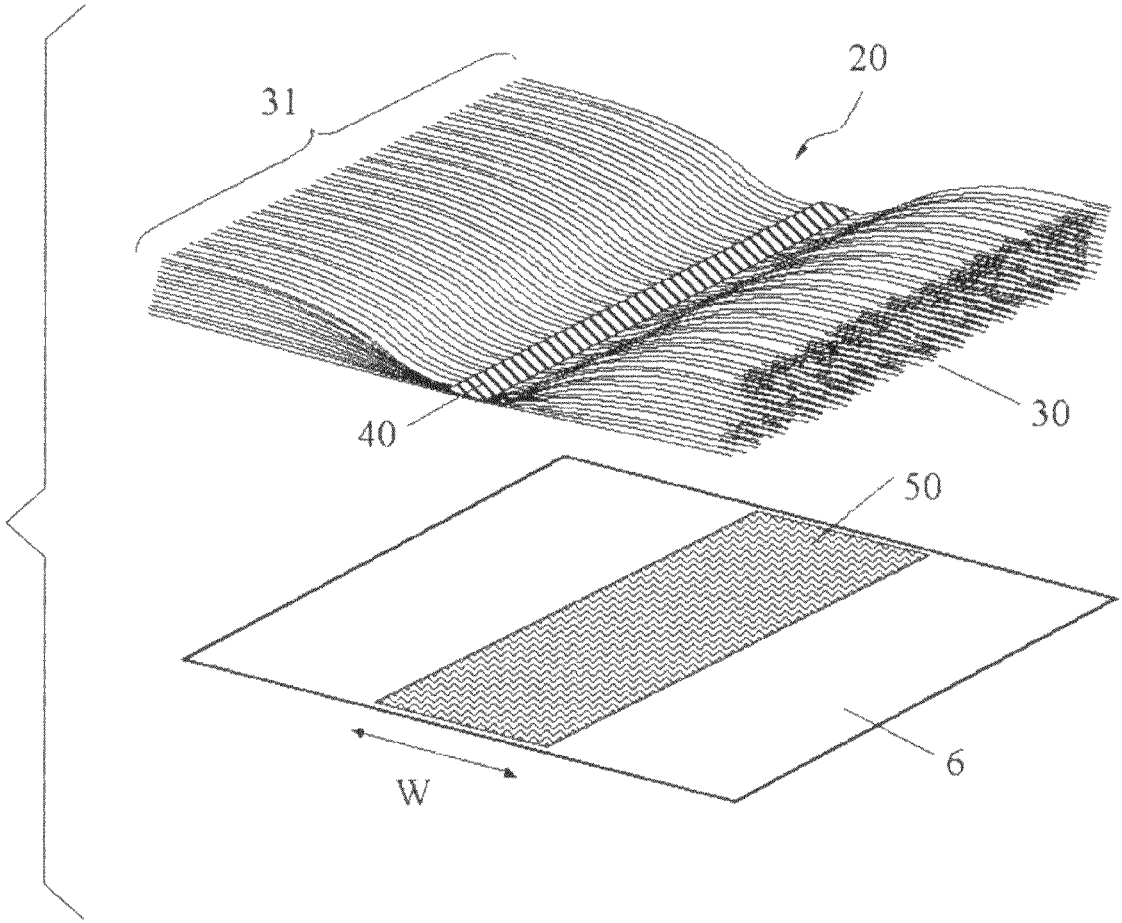
FIG. 6 is an exploded perspective view of the cleaning device according to the second embodiment of the present invention.

FIG. 6 is an exploded perspective view of a cleaning device according to a second embodiment of the present invention. Reference numeral 6 indicates a base material sheet, reference numeral 20 indicates a main cleaning portion, and reference numeral 50 indicates an adhesive. A large number of filaments 30 aligned in the fiber direction and having fusibility are heat-sealed at a single band-like bundling portion 40 provided substantially at the center in the fiber direction, thereby forming a filament bundling body 31. This formation is effected prior to the bonding of the base material sheet 6 and the filament bundling body 31. For the base material sheet 6, a material as mentioned with reference to the first embodiment can be selected. Further, in the peripheral edge portion of the base material sheet 6, it is possible to provide a plurality of strips 10 to form a sub cleaning portion. FIG. 6 shows how a cleaning device according to the present invention is obtained by bonding the filament bundling body 31 to the base material sheet 6 by means of the adhesive 50 applied to the base material sheet 6 over a width W.

The cleaning device of the present invention can be used as a cleaning cloth for wiping off dust with the filaments 30 which condition becomes flat with respect to the base material sheet 6, or as a mop head with the forward ends of the filaments 30 bulged and fluffed out of the plane of the base material sheet 6, or as something in between with part of the filaments 30 fluffed. In any of these cases, the cleaning device of the present invention is characterized in that dust is wiped off and caught by the main cleaning portion 20 formed by the filaments 30.

The filaments 30 are fixed to the cleaning device 1 by the bundling portion connecting the filaments to each other, and, in some cases, by the adhesion bonding portion for connection with the base material sheet 6. The sections of the filaments 30 from the portions thereof which are fixed to the bundling portions or the bonding portions nearest to the outermost side edges of the filament bundling body 31 (hereinafter referred to as the "fixed ends") to the distal ends thereof serve as movable portions (hereinafter, the portions from the fixed ends to the distal ends will be referred to as the "movable portions"). That is, each filament 30 has movable portions of a predetermined length neither bundled with other filaments nor bonded to the base material sheet 6. The movable portions are freely movable around the fixed ends to constitute the main cleaning portion 20.

For an improvement in dust collecting performance, it is desirable, in the cleaning device of the present invention, that the number of movable portions be large and that each has a large length. Thus, in order that distal ends may be provided at either end of the filaments 30, it is desirable that the filaments of the filament bundling body 31 be bundled with each other at substantially the central position except for the end portions in the fiber direction, and be bonded to the base material sheet 6.

Figure 7:
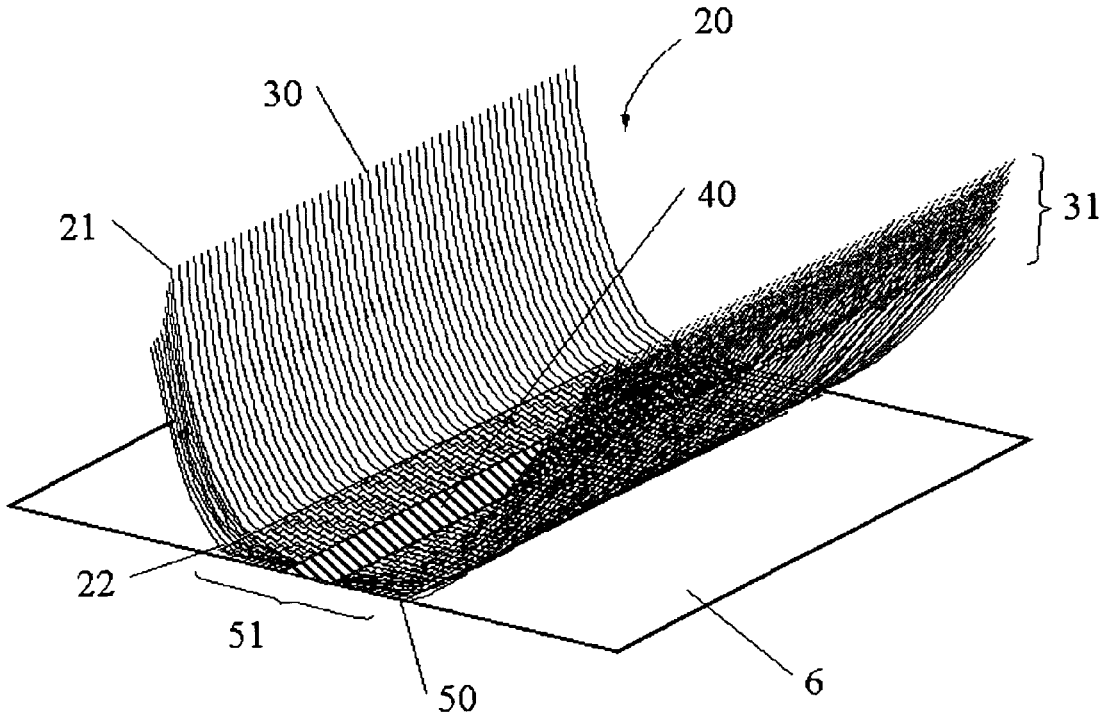
FIG. 7 is a perspective view of a cleaning device according to a third embodiment of the present invention.

FIG. 7 is a perspective view of a cleaning device according to a third embodiment of the present invention. In this embodiment, the main cleaning portion 20 is bulged and fluffed into a mop head shape. The filaments 30 are bundled together at the band-like bundling portion 40 to first form the filament bundling body 31. Thereafter, at substantially the central portion with respect to the fiber direction, the filament bundling body 31 and the base material sheet 6 are bonded to each other by means of the adhesive 50 at a band-like bonding portion 51 with a width including the bundling portion 40. The movable portions of the filaments 30 form the main cleaning portion 20. By fluffing the main cleaning portion 20 outside the plane of the base material sheet 6, it is possible to obtain the mop-head-like cleaning device of this embodiment. Since the distal ends 21 can move around in a wide range, the cleaning device of this embodiment is capable of not only capturing dust on a flat surface or a convex surface but also scraping out dust in a groove and catching the same.

In the second and third embodiments described above, it is also desirable to place a brush sheet with a plurality of bristle-like members between the filament bundling body 31 and the base material sheet 6 and to integrally bond them to each other by means of an adhesive.

Here, description will be made on the advantage of a certain variation, between filaments 30 close to each other, in the lengths and positions of the movable portions of the filaments 30, that is, the lengths from the fixed ends 22 to the distal ends 21 of the filaments 30 and the positional relationship thereof. When the lengths of the movable portions and the positions of the fixed ends 22 greatly differ between filaments 30 close to each other, the movable ranges of the distal ends 21 also greatly differ. Thus, the dust collection areas covered by the individual movable portions differ from each other, so that in the main cleaning portion 20 as a whole, the dust collection areas overlap each other, making it easy to obtain a dust collection performance free from spots.

Further, since the positions of the distal ends 21 of filaments 30 close to each other and their movable ranges greatly differ, it is advantageously easy to avoid a deterioration in the dust collection performance of the main cleaning portion 20 due to entanglement and conglomeration of the filaments 30.

There are several methods of achieving such effects. All of the following methods, which have been described above, provide an effect of discontinuously varying the lengths and the positions of the filaments 30:

(A) the method in which a variation is previously imparted to the lengths of the filaments 30;

(B) the method in which when bundling the filaments 30 together to form the filament bundling body 31, the positions of the filaments 30 in the fiber directions are made irregular; and (C) the method in which the bundling portion 40 for bundling together the filaments 30 is formed by a plurality of short linear portions provided in a zigzag fashion.

Further, in the method of the present invention, in which the filament bundling body 31 and the base material sheet 6 are bonded to each other by means of an adhesive, it is possible to obtain an effect of varying the lengths and the positions of the movable portions still more discontinuously. The filaments 30 contained in the filament bundling body 31 include filaments close to each other in the height direction (vertical direction) as from the base material sheet 6 and in the in-plane direction (lateral direction) of the base material sheet 6.

Of these, description will be made first on the principle underlying the fact that the lengths and the positions of the movable portions formed at the ends of filaments close to each other in the vertical direction greatly differ in some cases in the bonding system using an adhesive. The liquid adhesive applied between the base material sheet and the filament bundling body permeates in the height direction from the base material sheet through the gaps between the filaments to a certain height (depth) by capillary action. It should be noted, however, that a slight difference not only in the application thickness of the adhesive but also in the local density of the filaments and the wettability of the fiber surfaces leads to a difference in the permeation depth, with the result that the adhesion pattern of the filaments becomes inevitably complicated.

Figure 8:
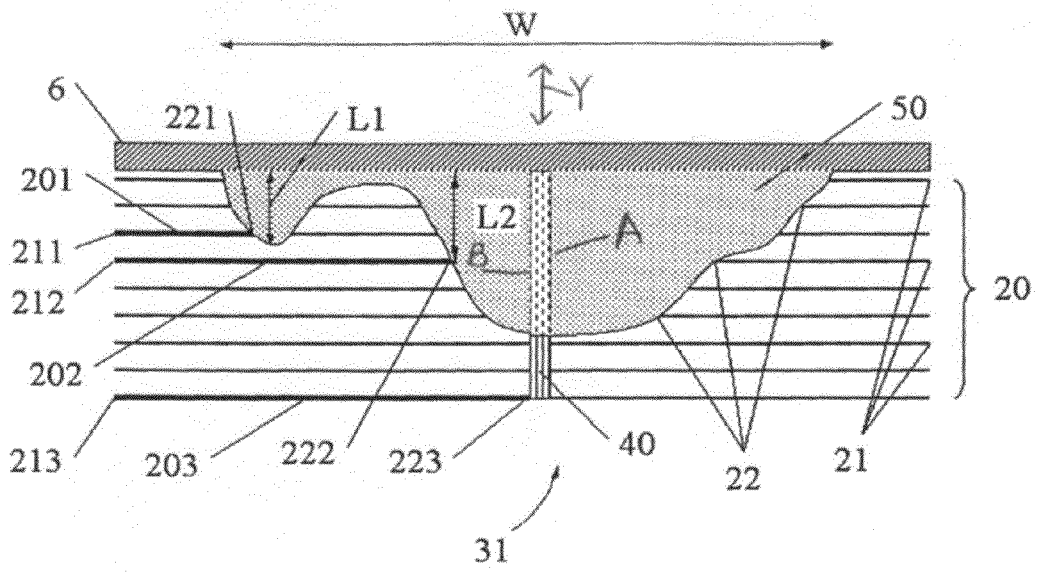
FIG. 8 is a schematic sectional view of an adhesion bonding portion.

As a specific example, FIG. 8 shows a schematic sectional view of the adhesion bonding portion between the base material sheet 6 and the filament bundling body 31 taken along the fiber direction of the filaments. Reference numeral 21 indicates representative distal ends of filaments, reference numeral 22 indicates fixed ends, reference symbols L1 and L2 indicate permeation depths of the adhesive 50, reference numerals 211 through 213 indicate distal ends at different depth positions, and reference numerals 221 through 223 indicate the corresponding fixed ends at these depths. The sections between their respective fixed ends and distal ends constitute movable portions 201 through 203. Due to its permeability, the adhesive 50 applied to the base material sheet 6 permeates through the gaps of the filaments to a predetermined depth. Thus, not only are the uppermost filaments in direct contact with the base material sheet 6 but also the filaments existing within the predetermined depth are glued and bonded to the base material sheet 6 by the adhesive 50, so that the fixed end positions of these filaments are relatively close to the distal ends thereof (as in the case of the fixed ends 221, 222). As a result, the lengths of the movable portions are small (as in the case of the movable portions 201, 202). On the other hand, the filaments which are at depth positions to which the adhesive 50 does not permeate are connected to the base material sheet 6 solely through the intermediation of the bundling portion 40, so that the fixed end positions of these filaments are near the central portions thereof (as in the case of the fixed end 223), and the lengths of the movable portions of these filaments are relatively large (as in the case of the movable portion 203). Further, as shown in FIG. 8, the movable portions 201 and 202 adjacent to each other in the height direction (vertical direction) as from the base material sheet 6 greatly differ in their lengths due to the permeation spot of the adhesive 50.

Described next will be the principle underlying the fact that, in the bonding system using an adhesive, the lengths and positions of filaments close to each other in the in-plane direction (lateral direction) of the base material sheet 6 differ greatly in some cases. In bonding the base material sheet and the filament bundling body to each other by means of an adhesive, the shape and area in which the adhesive is applied are arbitrary, and it is possible to effect bonding at a plurality of spotted positions.

Figure 9:
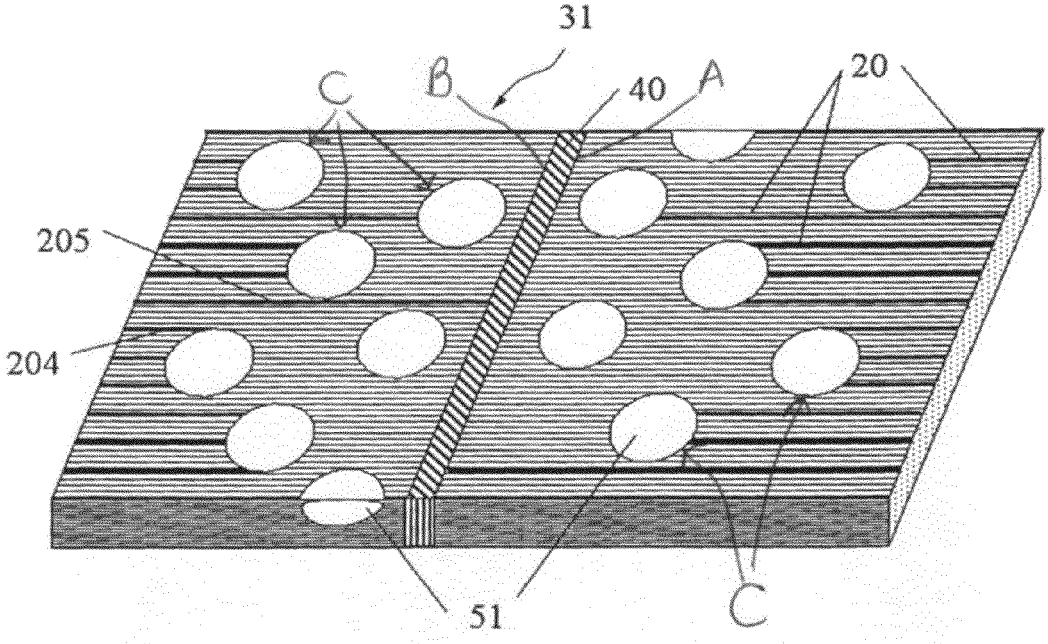
FIG. 9 is a perspective view of a filament bundling body with spotted adhesion bonding portions.

For example, as shown in the perspective view of FIG. 9, it is also possible to glue and bond the base material sheet 6 and the filament bundling body 31 to each other by a plurality of spot-like bonding portions 51. In the drawing, the upper side is the surface bonded to the lower surface of the base material sheet 6 (not shown), and the lower side is the dust collecting surface. Further, representative movable portions constituting the main cleaning portion 20 are indicated by thick lines.

As shown in the drawings, through dispersed arrangement of the spot-like bonding portions 51 at a plurality of positions in the substantially central portion with respect to the fiber direction of the filament bundling body 31, a movable portion 204 of any filament 30 near the distal end of which there exists a bonding portion 51 is short. In contrast, in a portion where no bonding portion 51 is provided, the filament is bonded solely by the bundling portion 40, so that the length of the movable portion 205 of the filament is substantially half the length of thereof. In this way, by providing a plurality of spotted bonding portions 51, it is possible, in the main cleaning portion 20, to make the lengths of the movable portions close to each other in the lateral direction to differ greatly in a discontinuous manner.

As described above, in the system of the present invention, in which the base material sheet and the filament bundling body are bonded to each other by means of an adhesive, it is possible to make the lengths of the movable portions in the main cleaning portion differ in a discontinuous manner in the height (vertical) direction and in the in-plane (lateral) direction. As a result, also in the case in which the main cleaning portion is bulged and fluffed to obtain a mop-head-like cleaning device, there is no fear of entanglement and conglomeration of the filaments due to the difference in the lengths of the movable portions from position to position, whereby the dust collection performance of the cleaning device does not deteriorate even after repeated use.

In the case of the conventional heat sealing system, all the filaments are fused and held in press contact with the base material sheet directly below the press line, which constitutes the bundling portion, and, in contrast, in the portions other than the press line, the filaments and the base material sheet are not bonded to each other at all. Thus, there is no change in the presence/absence of bondage between the base material sheet and the filaments depending upon the depth positions of the filaments, and it is impossible to obtain the effect of making the lengths and the positions of the movable portions discontinuous in the vertical direction.

Further, in the heat sealing system, in order to uniformly heat the filaments, a hot cutter with a small edge width is generally used in the press heater, so that the bundling portion has a simple linear configuration. Thus, to make the lengths and positions of the movable portions discontinuous in the lateral direction, it is necessary to adopt one of the following two methods. In the first method, heating and pressurization are effected by using a press heater of a special configuration in which the head branches off and protrudes at predetermined dotted positions. In the second method, by using an ordinary press heater with a simple forward end configuration, positioning and heating/pressurization with respect to predetermined dotted positions are repeated the number of times that the bonding portions are dotted. In the first method, the production of the special press heater requires cost, and it is very difficult to uniformly heat and pressurize the filaments by using a head of such a complicated configuration. Thus, a deterioration in bonding quality due to temperature spots and a thermal deterioration of the material are likely to occur. In the second method, the processing cost is high due to the repeated heat sealing operation. Further, the portions previously heated and bonded are gradually cooled and undergo thermal contraction, and the positioning of the other bonding portions 51 and heat sealing must be conducted while involving overall distortion, so that there is a fear of a deterioration in processing accuracy.

Apart from being used as a wipe-off sheet for cleaning, the upper surface of the base material sheet may be processed in various ways. More specifically, it may be processed into a mitten-like portion capable of accommodating the hand or foot of the user; it may be provided with a handle mounting portion for mounting a handle; it may be provided with another main cleaning portion separate from the one on the lower surface of the base material sheet; or it is possible to adopt a combination of these arrangements.

Figure 10:
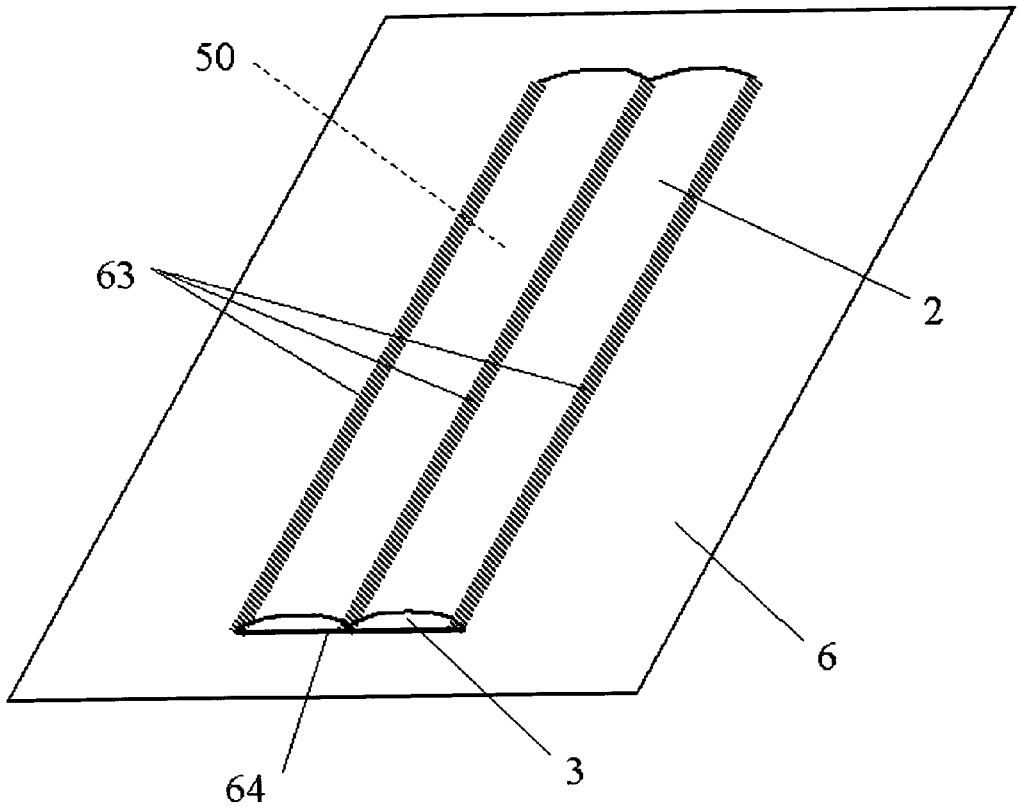
FIG. 10 is a perspective view showing how a base material sheet and a handle mounting portion are bonded together.

FIG. 10 is a perspective view showing an example of the method of providing the handle mounting portion 2 on the upper surface of the base material sheet 6.

The handle mounting portion 2 is formed of a non-woven fabric sheet with fusibility. While there are no particular limitations regarding the method of manufacturing the handle mounting portion, it is possible, for example, superimpose two non-woven fabric sheets one upon the other, and fuse them to each other at three fusion lines 63 arranged at predetermined intervals. Alternatively, it is also possible to divide a single non-woven fabric sheet into two portions by folding it, and to fuse these portions to each other at three fusion lines arranged at predetermined intervals or at two fusion lines exclusive of the folding line. As a result, bag-like handle mounting portions 2 with a mounting portion base 64 at their bottom are formed separately from the base material sheet 6. At one end of the handle mounting portions 2, two insertion holes 3 are formed side by side, and the support bars 5 of the handle 4 shown in FIG. 1 can be respectively inserted into them. The other end of the handle mounting portions 2 may be sealed by fusion, or left open so as to allow insertion of the support bars 5 from both sides.

At the fusion lines 63, the fibers forming the non-woven fabric are fused with each other to fill the fiber gaps, and scattering of transmitted light is suppressed, whereby it is possible to achieve an improvement in light transmissivity. Thus, when, in bonding the handle mounting portions 2 to the base material sheet 6, the mounting base 64 and the upper surface of the base material sheet 6 are bonded together by means of a colored adhesive 50, it is easy to visually recognize the color of the adhesive 50 from the fusion lines 63. Due to this arrangement, as compared with the case in which no fusion lines 63 are provided in the handle mounting portions 2, it is possible to more suitably attain an effect in artistic design for the base material sheet 6. Further, it is easier to visually recognize the contour line of the handle mounting portions 2 and, by extension, the positions of the insertion holes 3, whereby the operation of mounting the handle 4 is facilitated. There are no particular limitations regarding the coloring agent for coloring the adhesive 50; it is possible to suitably use pigments, such as natural mineral pigment, inorganic synthetic pigment, insoluble organic pigment, and lake pigment, or dyes, such as natural dye, synthetic dye, and fluorescent dye.

In this way, apart from the bonding of the main cleaning portion 20 to the lower surface of the base material sheet 6, and the formation of a subcleaning portion through provision of strips in the peripheral edge portion of the base material sheet 6 itself, it is desirable to perform various kinds of processing also on the upper surface thereof to thereby achieve an improvement in terms of usability as a cleaning device. In the conventional system in which the fibers and the base material sheet are integrally bonded together by heat sealing, a convex press mark is generated on the upper surface of the base material sheet, which is liable to impair the workability of the same. In contrast, in a system in which, as in the present invention, the fiber bundle and the base material sheet are bonded together, there is no need to apply excessive heat and pressure in the bonding process, so that the above problem is eliminated, and the bonding of the handle mounting portions 2, for example, can be conducted suitably.

As a specific example of the method of producing a cleaning device according to the present invention, there will be described a method in which fusible filaments and a base material sheet formed of non-woven fabric are bonded to each other by a hot melt type adhesive to thereby obtain a cleaning device. That is, in a first step, opening tows formed of fusible filaments are first stacked together in a planar fashion to form a fiber aggregate. In a second step, the substantially central portions of the fiber aggregate in the fiber direction are bonded together by heat sealing in a line running in a direction perpendicular to the fiber direction to obtain a filament bundling body. In a third step, a hot melt type adhesive is applied to a plurality of positions on one surface of the non-woven fabric sheet in a spotted fashion at room temperature. In a fourth step, this is stacked together with the filament bundling body. In a fifth step, they are pressurized entirely by a roll heater, and heated to a temperature not lower than the melting point of the hot melt type adhesive, impregnating the filament bundling body with the adhesive. In a sixth step, the whole is cooled to cure the hot melt type adhesive, and the non-woven fabric sheet and the filament bundling body are firmly attached to each other. In a seventh step, both end portions in the fiber direction of the filament bundling body are fluffed to thereby obtain a mop-head-like cleaning device.

In the fifth step or the sixth step, in order to bond the base material sheet 6 and the filament bundling body 31 to each other to a sufficient degree, it is also suitable, in addition to the heating and pressurization of the whole by the heater roll, to further heat and pressurize a predetermined portion alone by means of a hot cutter.

Figure 11:
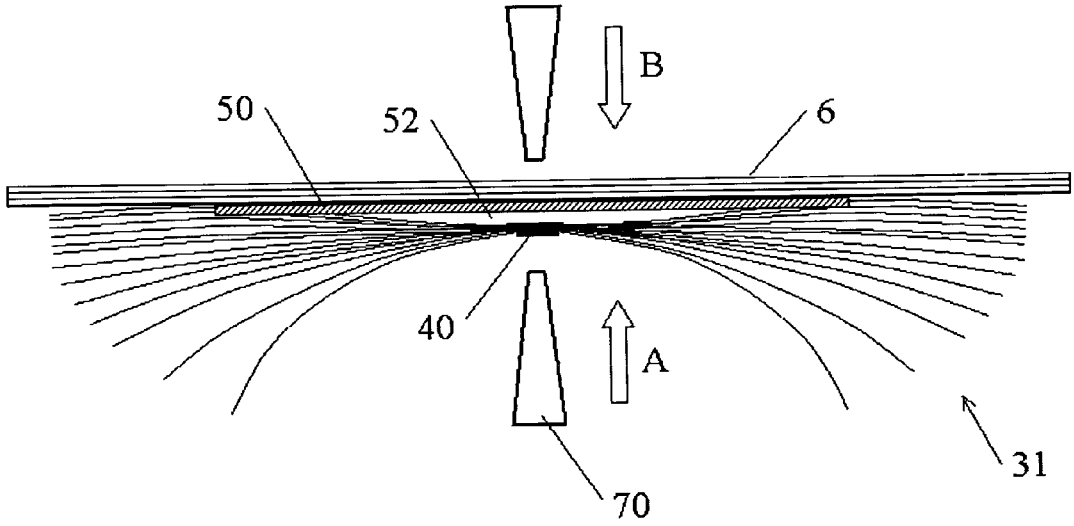
FIG. 11 is a sectional view of an adhesion bonding portion between a base material sheet and a filament bundling body.

For example, as shown in FIG. 6, the filament bundling body 31 formed by bundling together a large number of filaments by fusion at the substantially central portion in the fiber direction, is crushed thin in the vicinity of the bundling portion 40. Thus, when stacking the filament bundling body 31 together with the base material sheet 6, the bundling portion 40 of the filament bundling body 31 is not in close contact with the lower surface of the base material sheet 6, generating a gap 52 at this position (FIG. 11).

In applying a hot melt type adhesive between the filament bundling body 31 and the base material sheet 6 in order to bond them to each other, when the adhesive is applied in an amount larger than usual, both components are reliably bonded together, providing a predetermined adhesion strength. When, however, the application amount of adhesive remains a usual amount, the above-mentioned gap 52 is not sufficiently filled with adhesive, and there is a fear of the adhesion strength where the filament bundling body 31 is bonded to the base material sheet 6 at the bundling portion 40 being rather insufficient. In the latter case, it is desirable to press, as a post process, a hot cutter 70 against the bonding portion where the filament bundling body 31 is bonded to the base material sheet 6 at the bundling portion 40. The hot cutter 70 may be pressed from the filament bundling body 31 side (as indicated by an arrow A in the drawing), or from the base material sheet 6 side (as indicated by an arrow B in the drawing), or from both sides so as to pinch them. Due to this arrangement, the above-mentioned gap 52 is filled with adhesive, and a predetermined adhesion strength can be imparted thereto.

In this post processing, the temperature of the hot cutter 70 may be not lower than that of the filaments 31 or the base material sheet 6, with the filament bundling body 31 and the base material sheet 6 being partially or entirely fused to each other in the direction of their thickness. As a result, the bonding force due to the fusion is supplementarily added to the bonding force due to the adhesive 50, making it possible to bond the filament bundling body 31 and the base material sheet 6 to each other in a more satisfactory manner. In the execution of this post processing, as compared with the conventional system in which the filaments and the base material sheet are integrally bonded to each other solely by heat sealing, the pressurizing force with which the hot cutter 70 is pressed is smaller, the edge temperature of the hot cutter 70 is lower, and the pressurization time is also shorter. Thus, there is no fear of the adhesion bonding portion between the filament bundling body 31 and the base material sheet 6 being cured or a press mark remaining on the upper surface of the base material sheet 6; further, the production efficiency for the cleaning device is not markedly deteriorated.

According to the present invention, the bonding of the fiber bundle 7 and the base material sheet 6 can be effected reliably and efficiently. That is, in the case in which the fiber bundle 7 composed of fibers with fusibility and the base material sheet 6 formed of non-woven fabric are used, when the bonding of the fiber bundle 7 to the non-woven fabric is to be executed by heat sealing alone, the hot cutter applied to the fiber bundle 7 first melts the fibers by heating, and then the heat is conducted to the non-woven fabric to melt the non-woven fabric by heating. However, the non-woven fabric is a fiber entanglement body, and its surface exhibits surface irregularities, so that it is rather difficult for the heat to be conducted uniformly. In addition, the non-woven fabric has a void texture, so that its heat transfer efficiency is low. Thus, the fiber bundle 7, which is in uniform contact with the hot cutter, is quickly heated and melted, whereas it is rather difficult to integrally fuse the fiber bundle 7 and the non-woven fabric even when the non-wove fabric is formed of fibers which are of the same material and have the same diameter as the fibers forming the fiber bundle 7.

As a result, in the conventional technique, in which the base material sheet 6 and the fiber bundle 7 are integrally heat-sealed with each other, defective fusion occurs when the heat supply is insufficient, resulting in detachment of fibers from the base material sheet 6. Further, when excessive heat supply is effected in order to prevent defective fusion, the fiber and the non-woven fabric suffer thermal deterioration. Thus, the fact of the matter is that the hot cutter is kept pressed for heat sealing for a somewhat long time at a temperature which will not involve thermal deterioration of the materials, resulting in a reduction in production efficiency.

In the present invention, only the fibers are first bundled together to form the fiber bundle 7 by any of the above methods, and this fiber bundle is bonded to the base material sheet 6. Thus, if the fibers are bundled together by heat sealing, the fibers can be fused to each other efficiently in a short period of time. Thus, even though the adhesion step is added, it is advantageously possible to generally make the processing time much shorter as compared with the conventional system in which the fiber bundle 7 and the base sheet material 6 are integrally bonded together solely by heat sealing.

Further, in the present invention, when a non-woven fabric is used as the base material sheet 6, it is possible to make the bonding structure for the non-woven fabric and the fibers still firmer. That is, when the adhesive is applied to the position where the fibers and the non-woven fabric are bonded together, the adhesive not only permeates through the spaces between the fibers but also through the fiber voids of the non-woven fabric. In particular, the non-woven fabric is in a state in which short fibers are entangled with each other, so that the adhesive enters fiber voids of a complicated configuration, where by a great anchor effect is obtained, with the adhesive being melt-solidified or dry-solidified. Due to this anchor effect, a strong bonding force for the fibers and the non-woven fabric is obtained.

INDUSTRIAL APPLICABILITY

The cleaning device of the present invention provides a high degree of freedom in terms of the selection of the materials for the fibers and the base material sheet. Thus, the cleaning device can perform dust collection not only on household dust adhering to a piece of furniture such as a chest of drawers, an electric appliance such as a personal computer or a light, a wall in a building, a threshold, a lintel, etc., but also on dust generated in various fields, by selecting optimum fibers according to the physical properties of the dust, such as the grain size, polarity, and electrostatic property.

The invention claimed is:

1. A cleaning device comprising:

a base material sheet; and a fiber bundle comprising a large number of fibers aligned in a longitudinal direction thereof, and having a bundling portion connecting the fibers at a center portion thereof along a direction of extension crossing the longitudinal direction of the fibers, said bundling portion having edges extending generally parallel to said direction of extension, wherein the fiber bundle is bonded to the base material sheet by means of an adhesive, and the fiber bundle comprises movable portions which have respectively different lengths between (1) respective edges of the bundling portion and portions of the fibers bonded by the adhesive, and (2) between distal ends of the fibers in the longitudinal direction thereof and the portions of the fibers bonded by the adhesive.

2. The cleaning device according to claim 1, wherein the adhesive is provided between the base material sheet and the fiber bundle, and the adhesive is applied to the fibers at different permeation depths of the fiber bundle.

3. The cleaning device according to claim 2, wherein the base material sheet and the fiber bundle are joined at a center portion in a longitudinal direction along the bundling portion, and are joined by a plurality of spot-like bonding portions along both sides opposite to the bundling portion.

4. The cleaning device according to claim 3, wherein the plurality of spot-bonding portions is arranged dispersedly.

5. The cleaning device according to claim 1, wherein a plurality of spot-like bonding portions joining the base material sheet and the fiber bundle are provided along both sides opposite to the bundling portion.

6. The cleaning device according to claim 1, wherein a bonding portion joining the base material sheet and the fiber bundle is provided linearly along both sides opposite to the bundling portion.

7. The cleaning device according to claim 1, wherein the base material sheet has a plurality of strips provided along both sides opposite to the bundling portion.

8. The cleaning device according to claim 1, wherein the fiber bundle is comprised of a low degree fiber bundle composed of fibers having a low degree of thickness and a high degree fiber bundle composed of fibers having a high degree of thickness, the low degree fiber bundle and the high degree fiber bundle being stacked together.

9. The cleaning device according to claim 1, wherein the adhesive is a hot melt type adhesive.

10. The cleaning device according to claim 1, wherein the adhesive contains a coloring agent.

11. The cleaning device according to claim 1, wherein the base material sheet has a handle mounting portion.

12. The cleaning device according to claim 1, wherein the fiber of the fiber bundle is a filament.

13. The cleaning device according to claim 1, wherein a brush sheet which has a plurality of bristle-like members is bonded to the fiber bundle at a bristle-like-member-less portion thereof by an adhesive.

14. The cleaning device according to claim 13, wherein the bristle-like members of the brush sheet have respectively a width larger than a diameter of each of the fibers of the fiber bundle.

15. The cleaning device according to claim 1, wherein the movable portions provided between the edges of the bundling portion and the distal ends of the fibers positioned adjacent to each other in the direction of extension of the bundling portion have respectively different lengths in a discontinuous manner.

16. The cleaning device according to claim 1, wherein the movable portions provided between the edges of the bundling portion and the distal ends of the fibers positioned adjacent to each other in the direction of extension of the bundling portion and in the length direction thereof have respectively different movable lengths.

* * * * *